US005204493A

United States Patent [19]

Christmann et al.

[11] Patent Number: 5,204,493

[45] Date of Patent: Apr. 20, 1993

[54] INERT INSERTION FOR EXPLOSIVE WAVE GUIDANCE IN SHAPED CHARGES

[76] Inventors: Wolfgang Christmann, Rotdornbusch 44, 5070 Berg. Gladbach, Paffrath; Gerhard Lindner, Schillerstr. 4a, 5064 Rösrath; Paul Lingens, Kursiefener Str. 22, 5068 Odenthal, all of Fed. Rep. of Germany

[21] Appl. No.: 102,262

[22] Filed: Nov. 30, 1979

[30] Foreign Application Priority Data

Dec. 4, 1978 [DE] Fed. Rep. of Germany ..... 2852359

[51] Int. Cl.[5] ..... F42B 1/02

[52] U.S. Cl. ..... 102/307

[58] Field of Search ..... 102/24 HC, 56 SC, 307

[56] References Cited

U.S. PATENT DOCUMENTS

| | | | |
|---|---|---|---|
| 2,809,585 | 10/1957 | Moses | 102/24 HC X |
| 2,900,905 | 8/1959 | McDougall | 102/24 HC |
| 3,292,536 | 12/1966 | Church et al. | 102/24 HC |
| 3,662,684 | 5/1972 | Bodinaux | 102/56 SC |
| 3,802,342 | 4/1974 | Berlot et al. | 102/56 SC X |
| 4,151,798 | 5/1979 | Ridgeway | 102/24 HC |

FOREIGN PATENT DOCUMENTS

| | | | |
|---|---|---|---|
| 1220306 | 6/1966 | Fed. Rep. of Germany | 102/24 HC |
| 1948058 | 3/1971 | Fed. Rep. of Germany | 102/24 HC |
| 1703593 | 9/1971 | Fed. Rep. of Germany . | |
| 1696660 | 11/1971 | Fed. Rep. of Germany . | |
| 2365774 | 9/1976 | France . | |

*Primary Examiner*—Peter A. Nelson

*Attorney, Agent, or Firm*—Antonelli, Terry, Stout & Kraus

[57] ABSTRACT

This task is solved according to the invention by a design corresponding to the characteristic of the claim. The inert insertion according to the invention has the shape of a cylinder with a cone or truncated cone-shaped extension whereby the transition from cylinder to extension takes place without break. The inert insertion is to be arranged in the explosive of the shaped charge oriented such that it points with its free end tapering to the cone tip or top surface, respectively, of the truncated cone in the direction to the primer charge and correspondingly with its cylindrical part in the direction to the lining of the shaped charge. This inert insertion from cylinder and cone or truncated cone, respectively, has been shown to be especially favorable in comparison to the well-known forms of inert insertion. The effect of shaped charge rounds equipped with it on modern multiplate targets was significantly better than those of charges with inert insertions of conventional form.

1 Claim, 2 Drawing Sheets

INERT INSERTION FOR EXPLOSIVE WAVE GUIDANCE IN SHAPED CHARGES

BACKGROUND OF THE INVENTION

Figure 1:
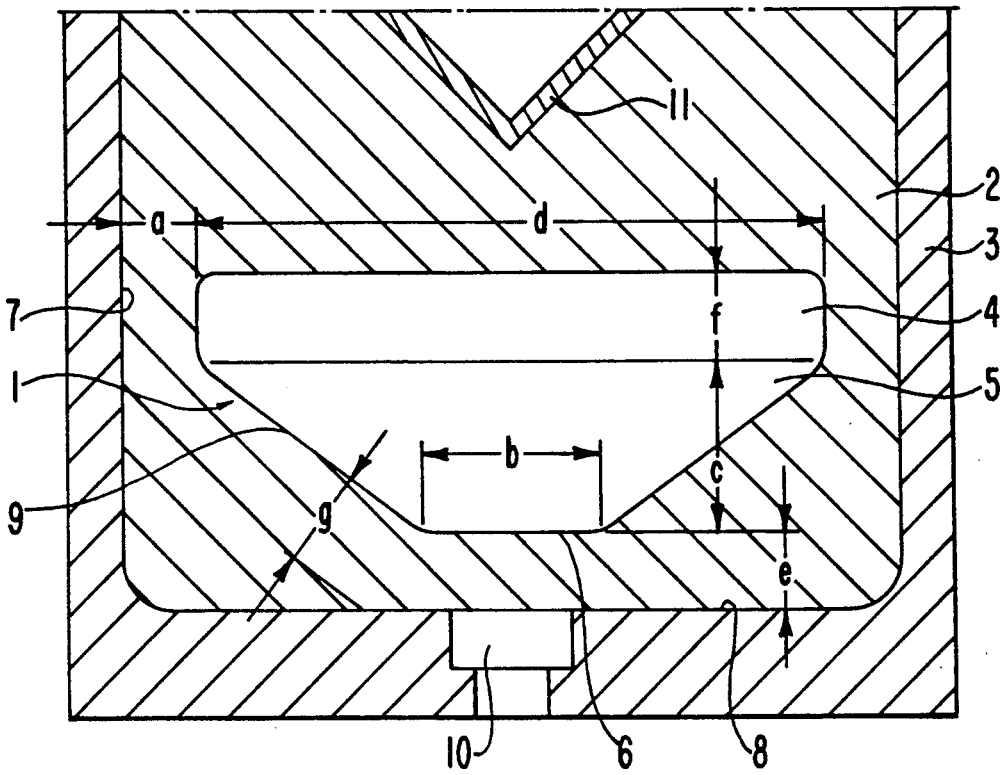

The invention concerns an inert insertion of the type stated in the description of the application.

The use of inert insertions for explosive wave guidance and thereby for increasing the effect of shaped charges is well known and is customary in many cases. The inert insertions are used as pure cylindrical shapes but also as pure cone shapes or even as truncated cones. In addition, cylindrical shapes with very sharply rounded-off edges on one side or both sides are well known. These inert insertions nevertheless do not result in sufficient penetration depths in modern multiplate targets and a relatively great dispersion of performance data.

The invention has the special task of increasing the shaped charge performance, more particularly with respect to modern multiplate targets, and decreasing the dispersion of performance data.

The inert insertion according to the invention can advantageously be used, for example, in shaped charge rounds for tube weapons, in shaped charge warheads of rockets and shaped charge mines. Their utilization takes place preferentially in shaped charges with funnel-shaped or approximately funnel-shaped charge lining. It is used preferentially in press-loadings, for example, of desensitized cyclonite (RDX) or HMX but can also be used in cast charges, for example from a mixture of TNT and cyclonite or HMX. It is preferentially made of plastic but can also be made from metal, ceramics or other inert materials. The edges of the inert insertion can be rounded off.

The inert insertion according to the invention is inserted in explosives which feature a cylindrical or approximately cylindrical shape at least in the area of the cylindrical part of the inert insertion. The inert insertion which features in the cross section the shape of a triangle or trapezoid, respectively, with mounted square has proven to be surprisingly favorable in the area of the dimensional relationships stated in the claim. The diameter d of the cylindrical part of the inert insertion amounts in this case preferentially between about 50 and 200 mm. If the small diameter b of the truncated cone is selected equal to zero, it follows that the truncated cone becomes a cone. The distance a of the cylindrical part from the lining of the explosive is thereby preferentially less than about 1/5 d. The thickness e of the explosive layer between the inert insertion and the bottom surface of the explosive is preferentially less than about ¼ d.

Figure 4:
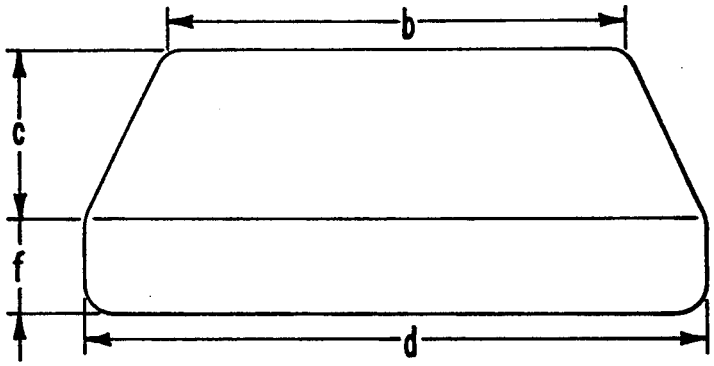
Figure 5:
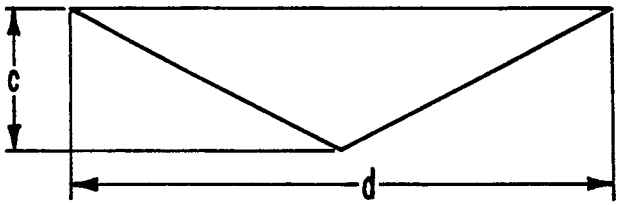
Figure 6:
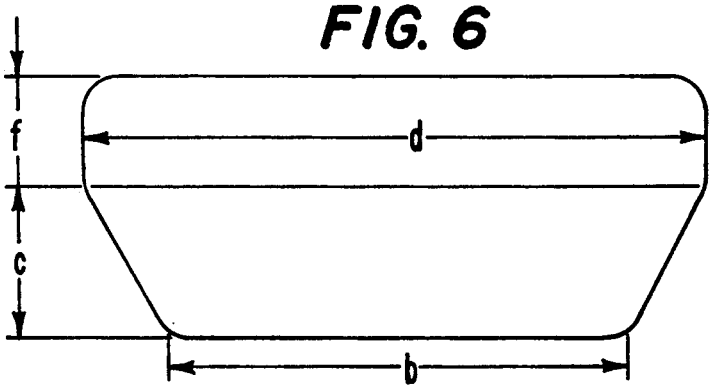
Figure 7:
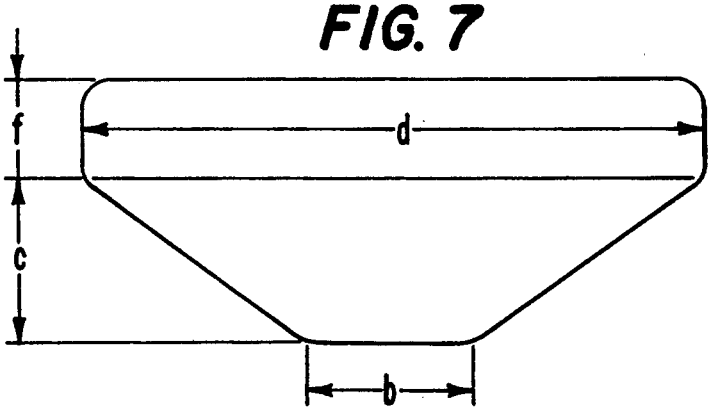

The invention is shown in forms of construction in the drawing and is explained still more in detail below on the basis of them. There may be seen:

FIG. 1—The rear part of a shaped charge in schematic representation and in longitudinal section, FIGS 2 to 5—Various inert insertions not according to the invention, and FIGS. 6 and 7—Inert insertions according to the invention shown always in side view.

According to FIG. 1, the inert insertion 1 shown in the view is imbedded in the explosive body 2 which is arranged for its part in the casing 3 of the shaped charge. The inert insertion 1 features the cylindrical part 4 and the truncated cone 5 which pass over continuously into one another with a slight rounding off of the edge so that the base surface of the truncated cone is equal to the underside of the cylinder. The part 4 has the diameter d and the height f whereas the truncated cone 5 has the small diameter b on its top surface 6 and the height c. The lateral distance to the envelope surface 7 of explosive 2 which coincides with the inside surface of casing 3 is characterized with a, the distance from top surface 6 to bottom surface 8 of the explosive is characterized with e and the minimum distance of the truncated cone surface 9 to the bottom surface is characterized with g. The bottom surface 8 represents simultaneously the end on the ignition side of the explosive 2. The inert insertion 1 is with top surface 6 facing the ignition device of the shaped charge to be arranged in recess 10 so that its cylindrical part is opposite the shaped charge lining 11.

For purposes of comparison, cylindrical hollow charges with a diameter of explosive body 2 of 106 mm and a shaped charge lining 11 made of copper with an angle of aperture of 60° and a wall thickness of 2.2 mm were made into a steel casing 3 with a 6 mm wall thickness with various inert insertions 1 for shaping the explosion wave. The distance e amounted uniformly to 10 mm for the Examples 1 to 8 and 10. The explosive used consisted of pressed cyclonite with 5 weight % wax. The testing of the performance of these shaped charge rounds took place on a modern multiplate target consisting of three steel plates with intermediate air spaces whereby, in the first two plates, it was necessary to penetrate a thickness of 20 and 50 mm and, in the last plate, 200 mm. The path through the intermediate air spaces between the plates was a total of 1300 mm. The distance between the edge of the shaped charge lining 11 and the first plate amounted to 170 mm.

EXAMPLE 1

Figure 2:
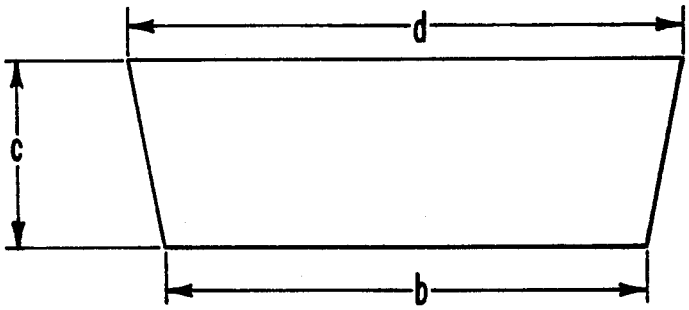

An inert insertion with a trapezoidal cross section made of polyamide resin was inserted into the described charge according to FIG. 2. Its dimensions were d=75 mm, b=65 mm and c=25 mm. This inert insertion does not correspond to the invention according to which it must feature a cone or truncated cone, respectively, with subsequent cylindrical part. Three shaped charge tests with inert insertion resulted in that the three-plate target was not penetrated in all three cases. The penetration depth of the shaped-charge jet in the last plate of the target always amounted on the average to 110 mm.

EXAMPLE 2

Figure 3:
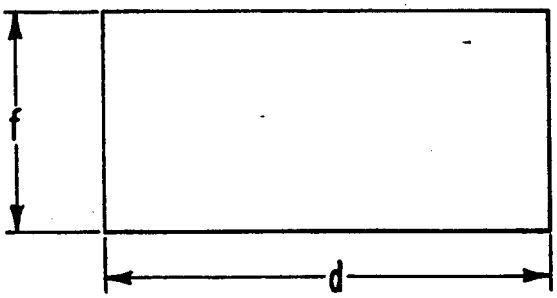

An inert insertion in the shape of a cylinder with d=60 mm and f=30 mm made of polyamide resin was inserted into the described charge according to FIG. 3. This inert insertion is also not according to the invention. Three shaped-charge tests with this inert insertion resulted that the three-plate target was penetrated in no instance. The penetration depth of the shaped-charge jet into the last plate amounted to 80 mm on the average.

EXAMPLE 3

An inert insertion made of polyamide resin in the shape of a truncated cone with mounted cylinder was inserted into the described charge according to FIG. 4. The dimensions were d=86 mm, b=64 mm, c=23 mm and f=13 mm and thereby in accordance with the invention. Contrary to the invention, the truncated cone, however, pointed in the direction of the shaped-charge lining. The multiple target was penetrated only one time out of five tests of this charge without a further residual performance in steel plates set up behind the actual target.

EXAMPLE 4

An inert insertion according to FIG. 5 was inserted with the shape of a cone with d=75 mm and c=20 mm. This inert insertion is not according to the invention. The multiple target was penetrated in no case in three tests. The penetration depth into the last plate amounted on the average always to 130 mm.

EXAMPLE 5

An inert insertion made of polyamide resin in the shape of a truncated cone with mounted cylindrical part with d=86 mm, b=64 mm, c=23 mm and f=13 mm was inserted according to FIG. 6 into the described charge. This inert insertion is still according to the invention in the dimensions. Five tests resulted that the selected three-plate target was penetrated four times. An average residual performance of 63 mm was achieved in steel plates set up behind the actual target.

EXAMPLE 6

An inert insertion according to FIG. 7 was used in which b=22 mm, deviating from FIG. 6. This insertion ranges in its dimensions in the middle of the area of the claim. The multiple target was always penetrated in 12 tests. The average residual performance in plates additionally set up behind the target amounted to 112 mm.

EXAMPLE 7

An inert insertion according to FIG. 7 was used. The height of the cylindrical part nevertheless amounted to f=32 mm=$\frac{2}{5}$ d instead of f=13 mm. This inert insertion is situated in the dimension f outside of the invention. The multiple target was only penetrated once in five tests. The penetration depth of the remaining tests amounted on the average to 120 mm in the last armor plate.

EXAMPLE 8

An inert insertion was used according to FIG. 7. The height of the truncated cone nevertheless amounted to c=57 mm=$\frac{2}{5}$ d instead of c=23 mm. This inert insertion is situated in the dimension c outside of the invention. The multiple target was penetrated in no case in five tests.

EXAMPLE 9

An inert insertion was used according to FIG. 7. The explosive layer e between inert layer and bottom of explosive nevertheless amounted to e=2 mm=1/43 d instead of 10 mm. This dimension of the explosive layer e is situated outside of the invention. The multiple target was penetrated in no case in five tests.

EXAMPLE 10

An inert insertion was used according to FIG. 7. The diameter of the cylindrical part nevertheless amounted to d=100 mm so that the explosive layer between the cylindrical part and the charge casing was given with a=3 mm=1/33 d. This dimension of the explosive layer a is situated outside of the invention. The multiple target was penetrated in no case in five tests.

Examples 5 and 6 clearly proved the superiority of shaped charges with inert insertions corresponding to the invention whereas the inert insertions used in Examples 1 to 4 feature clear reduced performances. Even almost similar inert inserts or attached explosive layers, respectively, differing only in one dimension still resulted in clear reduced performances according to Examples 7 to 10.

We claim:

1. Inert insertion for the explosive wave guidance in shaped charges featuring a cylindrical part and which is inserted into an explosive, characterized in that, on the cylindrical part (4) of the inert insertion (1), a cone or truncated cone (5), respectively, is continuously connected and whose tip or surface (6), respectively, is facing the ignition-side end (8) of the explosive (2) and in which with a diameter d of the cylindrical part (4)

the diameter b of surface (6) of truncated cone (5) is $\frac{3}{4}$ to 0 d, the height c of the cone or truncated cone (5), respectively, is $\frac{1}{2}$ to 1/10 d, the height f of cylindrical part (4) is $\frac{1}{4}$ to 1/10 d, the distance a of cylindrical part (4) from the envelope surface (7) of explosive (2) amounts to at least 1/25 d, and the thickness e of the explosive layer between the inert insertion (1) and the bottom surface (8) of the explosive (2) amounts to at least 1/25 d, and the minimum distance g of the cone or truncated cone surface (9), respectively, from the outer surface (8) of explosive (2) is at least as great as distance a.

* * * * *